US010060083B2

(12) United States Patent
White, Jr. et al.

(10) Patent No.: US 10,060,083 B2
(45) Date of Patent: Aug. 28, 2018

(54) SPRING TENSION SYSTEM FOR TILE

(71) Applicant: WHOLESALE TURF SUPPLY LLC, Dalton, GA (US)

(72) Inventors: Steve White, Jr., Dalton, GA (US); Ron Bennett, Dalton, GA (US)

(73) Assignee: VERSACOURT, LLC, Dalton, GA (US)

( * ) Notice: Subject to any disclaimer, the term of this patent is extended or adjusted under 35 U.S.C. 154(b) by 0 days.

(21) Appl. No.: 15/404,527

(22) Filed: Jan. 12, 2017

(65) Prior Publication Data

US 2017/0198442 A1 Jul. 13, 2017

Related U.S. Application Data

(60) Provisional application No. 62/277,661, filed on Jan. 12, 2016.

(51) Int. Cl.

| | |
|---|---|
| ***E01C 5/00*** | (2006.01) |
| ***E01C 13/08*** | (2006.01) |
| ***E01C 13/04*** | (2006.01) |
| ***E01C 11/02*** | (2006.01) |
| ***E01C 13/02*** | (2006.01) |
| ***E01C 17/00*** | (2006.01) |

(52) U.S. Cl.

CPC ..... *E01C 13/08* (2013.01); *E01C 5/005* (2013.01); *E01C 11/02* (2013.01); *E01C 13/02* (2013.01); *E01C 13/04* (2013.01); *E01C 17/00* (2013.01); *E01C 2201/12* (2013.01)

(58) Field of Classification Search

CPC ..... E01C 5/005; E01C 11/02

USPC ..... 403/327, DIG. 14; 404/40, 41, 47

See application file for complete search history.

(56) References Cited

U.S. PATENT DOCUMENTS

| | | | | | |
|---|---|---|---|---|---|
| 1,393,699 | A | * | 10/1921 | Purcell | E01C 5/08 404/40 |
| 4,193,573 | A | * | 3/1980 | Kinnucan, Jr. | E01C 11/14 249/192 |
| 4,436,779 | A | * | 3/1984 | Menconi | E01C 13/045 404/41 |
| 4,584,221 | A | * | 4/1986 | Kung | E01C 13/045 404/36 |
| 4,930,286 | A | * | 6/1990 | Kotler | E01C 13/045 404/41 |
| 4,980,117 | A | * | 12/1990 | Blaushild | F16J 15/061 376/205 |
| 5,134,386 | A | | 7/1992 | Swanic et al. | |

(Continued)

*Primary Examiner* — Gary S Hartmann

(74) *Attorney, Agent, or Firm* — Lathrop Gage L.L.P.

(57) ABSTRACT

A spring tension system for a floor tile has spring loop with a base portion and a hoop portion. The base portion has two arms extending outwardly at a first angle from a center-point which together to form the hoop portion. The spring loop is formed into a first side of a first floor tile. A tapered recess is formed into a second side of a second floor tile. The tapered recess includes an opening which forms two tapered walls which extend inwardly toward a center of the second floor tile at a second angle. The second angle is smaller than the first angle. The spring loop formed into the first side of the first floor tile is received into the tapered recess formed into the second side of the second floor tile, the spring loop contacting the walls of the tapered recess to form a friction fit.

17 Claims, 5 Drawing Sheets

(56) References Cited

U.S. PATENT DOCUMENTS 5,988,942 A * 11/1999 Atkinson ..... E02B 3/14 404/40
6,800,339 B2 10/2004 Motz et al.
6,950,599 B2 9/2005 Nicholls et al.
7,081,283 B2 7/2006 Straughn
7,086,205 B2 * 8/2006 Pervan ..... E04F 15/02 404/41
7,245,815 B2 7/2007 Nicholls et al.
7,486,868 B1 2/2009 Seacat et al.
7,532,781 B2 5/2009 Thompson et al.
7,748,177 B2 * 7/2010 Jenkins ..... E01C 5/20 15/215
7,874,761 B2 * 1/2011 Prokhorenkov ..... E01C 5/00 404/34
7,993,729 B2 8/2011 Wise
8,308,332 B1 11/2012 Suhr
9,039,541 B2 5/2015 De Vries et al.
2006/0236760 A1 10/2006 Belisle
2007/0223993 A1 * 9/2007 Peterson, Jr. ..... E01C 5/005 403/364
2009/0036200 A1 2/2009 Seacat et al.
2009/0088234 A1 4/2009 Seacat et al.
2009/0240695 A1 9/2009 Angell et al.
2009/0246418 A1 10/2009 Wise
2009/0305823 A1 12/2009 Belisle
2010/0154216 A1 6/2010 Hulen
2011/0023934 A1 2/2011 Xue et al.
2011/0117297 A1 5/2011 Harmeling
2011/0260890 A1 10/2011 Larsen et al.
2013/0243367 A1 9/2013 Belisle
2015/0013119 A1 * 1/2015 Beamish ..... E01C 9/08 24/464
2015/0104257 A1 4/2015 Cooley et al.
2015/0113842 A1 4/2015 Suhr
2015/0368866 A1 12/2015 Hydock
2017/0191227 A1 * 7/2017 Sylvester ..... E01C 5/005

* cited by examiner

FIG. 1 –
PRIOR ART

SPRING TENSION SYSTEM FOR TILE

CROSS-REFERENCE TO RELATED APPLICATIONS

This application claims priority to U.S. Provisional Patent Application No. 62/277,661, filed Jan. 12, 2016, which is incorporated herein by reference in its entirety.

BACKGROUND

It is estimated that the world-wide, synthetic turf, multi-purpose field market is around 60,000,000 square feet per year, which equates to around $500,000,000 per year spent on synthetic turf. The popularity of the synthetic turf industry is bolstered by the many benefits offered by synthetic turf, including eliminating the necessity of mowing the grass and worrying about growing grass in difficult areas. However, there are also several drawbacks of current synthetic turf systems.

For example, in the current method of installing synthetic turf, rubber is used as an infill. Rubber serves the important purpose of acting as a shock absorption layer, or attenuation layer. However, there are some concerns that ground-up rubber may cause cancer. Additionally, synthetic turf is around 35 degrees higher in temperature than natural grass fields. As a result of the higher temperature of the grass, heat exhaustion occurs more quickly for those on the synthetic turf.

Another large drawback is the significant cost associated with the purchase and installation of a synthetic turf field. On average, a synthetic turf field costs around $600,000, with most of that cost attributed to the work done below the surface (e.g., drainage and rock stabilization. Moreover, a single type of synthetic turf field is not appropriate in all situations. But due to the high cost, most fields are installed using an infill ratio of rubber to sand which favors the most prevalently played sport in that market. For example, in the Southern U.S. this is American football. However, fields may be primarily designed for soccer, lacrosse, baseball, or any other type of sport where artificial turf fields are desirable.

Accordingly, it may be beneficial to have a synthetic turf system that can be used with multiple sports and without the drawbacks of current synthetic turf systems.

SUMMARY

The following presents a simplified summary of the invention in order to provide a basic understanding of some aspects of the invention. This summary is not an extensive overview of the invention. It is not intended to identify critical elements of the invention or to delineate the scope of the invention. Its sole purpose is to present some concepts of the invention in a simplified form as a prelude to the more detailed description that is presented elsewhere herein.

In one embodiment, a spring tension system for a floor tile has spring loop with a base portion and a hoop portion. The base portion has two arms extending outwardly at a first angle from a center-point which together to form the hoop portion. The spring loop is formed into a first side of a first floor tile. A tapered recess is formed into a second side of a second floor tile. The tapered recess includes an opening which forms two tapered walls which extend inwardly toward a center of the second floor tile at a second angle. The second angle is smaller than the first angle. The spring loop formed into the first side of the first floor tile is received into the tapered recess formed into the second side of the second floor tile, the spring loop contacting the walls of the tapered recess to form a friction fit.

In another embodiment, a spring tension system for a tile includes a spring member formed into a first side of a first tile; and a recess formed into a second side of a second tile. The spring member of the first tile is received by the recess in the second tile to form an interference fit. The tension caused by the interference fit causes the first and second tiles to be biased into contact in a normal configuration.

In still another embodiment a spring tension system for a tile has a spring loop with a base portion and a loop portion. The base portion has two arms that extend outwardly from a first side of a first tile at a first angle. Respective ends of the arms join together to form the loop portion. A tapered recess is formed into a second side of a second wall tile. The tapered recess has an opening which is formed by two walls, each wall having an inner angled edge. The spring loop formed into the first tile is received into the tapered recess of the second tile to form a friction fit. The friction fit causes the spring loop to bias the respective tiles into contact.

WRITTEN DESCRIPTION

Embodiments of synthetic turf systems are disclosed herein. It shall be recognized that the various system components described herein may be individually beneficial, or may be combined as part of a more comprehensive synthetic turf system.

Figure 1:
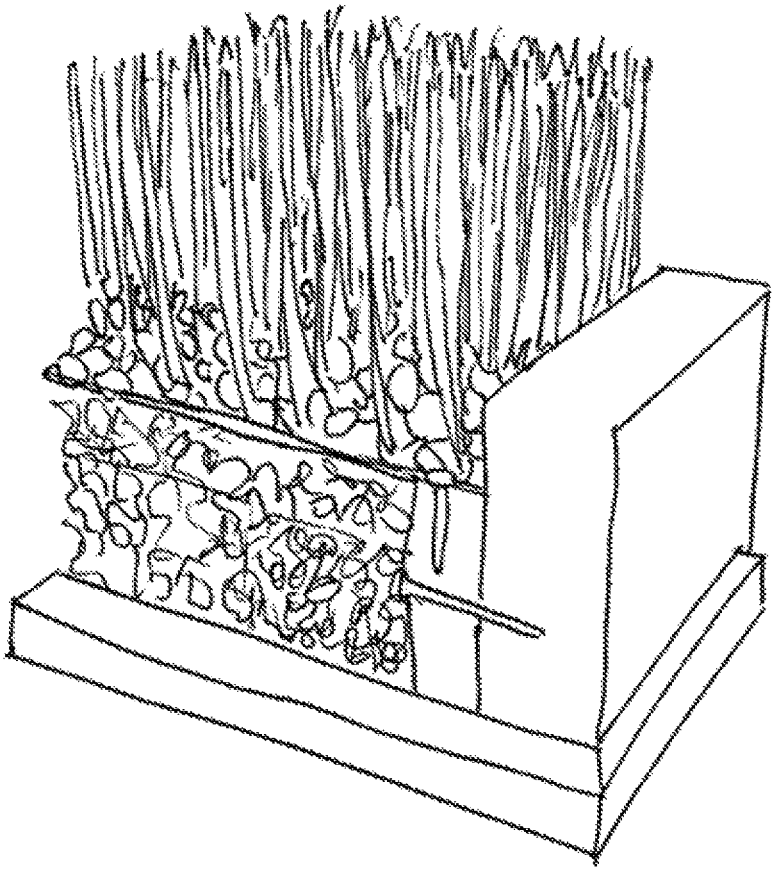
FIG. 1 is a section view of a prior art synthetic turf system according to one embodiment of the invention.

In one embodiment of the invention, a synthetic turf system includes a modular surface (e.g., tiles) to which the synthetic turf may be applied. The modular surface may eliminate the need for nearly 75% of the rock used in current synthetic turf sub-bases. FIG. 1 illustrates a prior art system showing such a sub-base. As described in greater detail herein, the tiles may be rigid enough to support itself and other tiles throughout the surface to ensure a stable playing surface. It shall be understood that the tiles may be configured in a variety of different shapes and sizes depending on the requirements of the surface to be covered.

Figure 2:
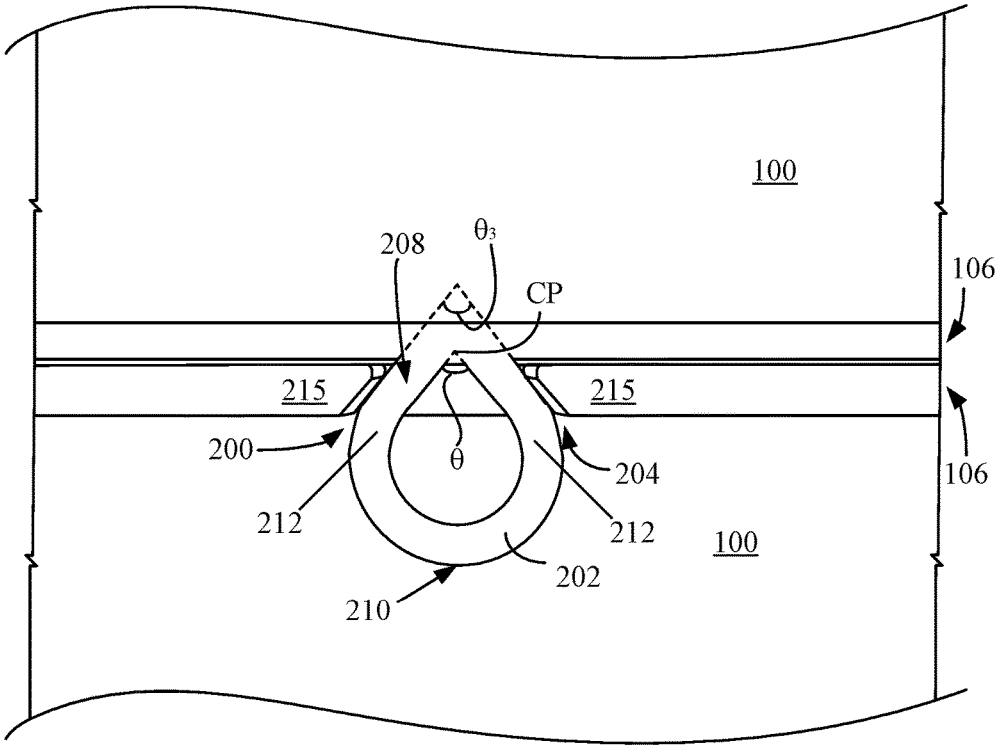
FIG. 2 is a bottom view of a tension spring system according to one embodiment of the invention.
Figure 3:
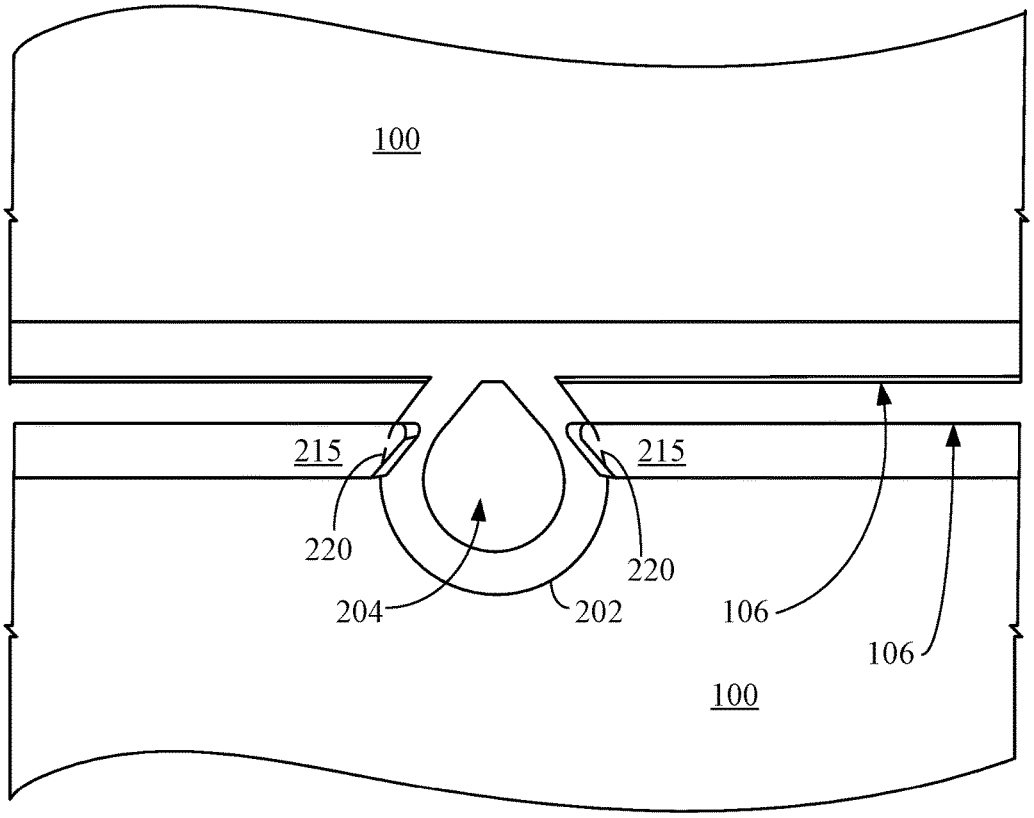
FIG. 3 is a bottom view of the tension spring system according to the embodiment of FIG. 2.
Figure 4:
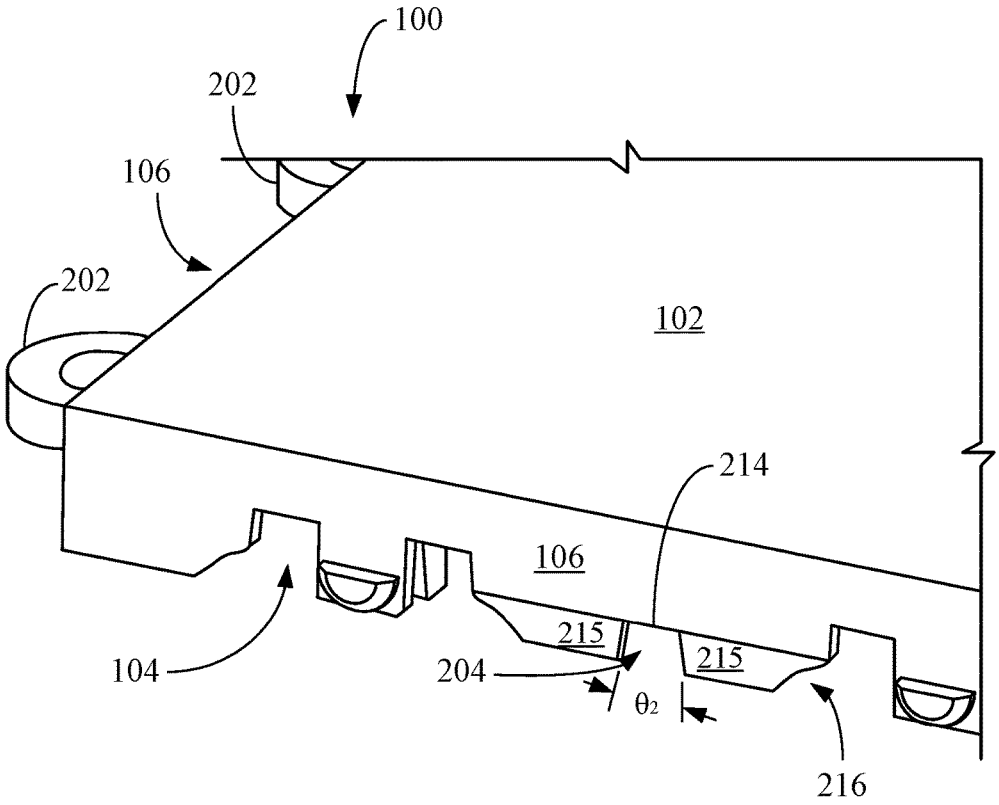
FIG. 4 is a perspective side view of a tile showing components of the tension spring system of FIG. 2.

Referring now to FIGS. 2-4, in one embodiment, a tile 100 includes a top surface 102 and a bottom surface 104, and respective edges 106 extending between the top and bottom surfaces 102 and 104. The top surface 102 may be equipped to receive synthetic turf thereupon. The bottom surface may include a plurality of support pegs. The support pegs help to provide support to the tile 100 from the underside, to prevent structural failure of the tile 100.

Each tile may be equipped with a spring tension system 200 for joining multiple tiles together. The spring tension system 200 may include a plurality of tension spring loops 202 and corresponding tapered recesses 204.

The tension spring loop 202 may be molded (e.g., via injection molding, co-injection molding, overmolding, multi-material injection molding, etc.) as part of a tile 100. One or more loops 202 may be formed along a single side 106 of a tile 100. Preferably, one or more loops 202 may be formed along multiple sides 106 of the tile 100 (e.g., along two adjacent sides 106, along three adjacent sides 106, along all four sides 106, and/or along two parallel sides 106). In one embodiment, each tile 100 has a plurality of tension spring loops 202 formed along two adjacent sides 106 of the tile.

The tension spring loop 202 has a base portion 208 and a hoop portion 210. The base portion 208 extends directly from the side 106 of the tile 100. The base portion 208 has two arms 212 extending at an angle θ from a center point CP at the base of the loop 202. The angle θ between the respective arms 212 may range from approximately 60 degrees to approximately 90 degrees. Preferably, the angle θ is about 75 degrees, and most preferably the angle θ is approximately 80 degrees.

The tension spring loop 202 may be formed of a resilient material that allows the loop 202 to flex. Accordingly, in one embodiment, it may be beneficial for the tension spring loop 202 to be co-molded with the tile 100, wherein the tile 100 is formed of a plastic material, such as a high-impact polypropylene polymer having a higher durometer value (indicating a harder material), while the loop 202 may be formed of a material such as a polypropylene polymer having a lower durometer (indicating a softer material). In another embodiment, the tension spring loop 202 and the tile 100 may be formed of the same material.

The tension spring loop 202 may be configured to be received by a tapered recess 204 on another tile 100. A plurality of tapered recesses 204 may be formed along multiple sides 106 of a tile 100 (e.g., along two adjacent sides 106, along three adjacent sides 106, along all four sides 106, and/or along two parallel sides 106). In one embodiment, each tile 100 has a plurality of tapered recesses 204 formed along two adjacent sides 106 of the tile 100. The adjacent sides 106 of the tile 100 having the tapered recesses 204 may thus be the sides 106 that do not have tension spring loop(s) 202. Accordingly, in one embodiment, two adjacent sides 106 of the tile 100 may be equipped with tension spring loops 202, and the other two adjacent sides 106 of the tile 100 may be equipped with tapered recesses 204.

The number of tapered recesses 204 may correspond to the number of loops 202. For example, if each tile 100 has two loops 202 per each of the sides 106 having loops 202, the sides having the tapered recesses 204 may each have two tapered recesses 204. It shall be understood that the tiles 100 in a system may be uniformly manufactured for easy and uniform installation.

The tapered recess 204 may be comprised of an opening 214 formed into a panel 216 on the respective side 106. The walls 215 of the opening 214 may have a front angle $\theta_2$ of between approximately 5 degrees and 15 degrees. Preferably, the angle $\theta_2$ is approximately 10 degrees.

The panel 216 may have a width W (FIG. 3) sufficient to maintain the tension spring 202 in the recess 204. In one embodiment, the width W is approximately between ⅛" and 0.5". In another embodiment, the width W is approximately between 0.25" and 0.75". As shown in FIG. 2, an angle $\theta_3$ of the inside edges of the walls 215 may generally correspond to angle θ. In one embodiment, angle $\theta_3$ is slightly smaller than angle θ (e.g., approximately between 70 and 80 degrees).

Prior art tiles employ locking means that promote holding the locked tiles as far apart as possible. This is to allow for expansion and contraction of the tile due to forces on the tiles, as well as due to changes in the environment (e.g., temperature). As a result, there is almost always a gap between the tiles. When a user moves over the tiles, the tiles flex, and the gap may close on the user causing the user to be pinched.

The novel tension system described herein works in reverse. In use, the tension spring loop(s) 202 on one side 106 of a tile 100 are inserted into respective tapered recesses 204 formed into a side 106 of another tile as illustrated in FIG. 2. To insert the tension spring loop 202 into the tapered recess 204, the loop 202 is deformed such that the hoop end 210 fits into the opening 214. The loop 202 may be deformed automatically when force is exerted on the tiles in a manner as to cause the tiles 100 to attach. Once the hoop end 210 is through the initial opening 214, the natural flexibility of the material causes the hop end 210 to return to its original shape. The spring loop 202 and the tapered recess 204 thus form an interference fit.

The interference fit causes the respective tiles 100 to be constantly and consistently drawn to one another. The tiles 100 are therefore not maintained in a spaced-apart position like prior art system, but rather meet at respective sides 106, and the space between the tiles 100 is therefore minimized. FIG. 2 illustrates two tiles 100 which are shown at a minimum spacing. Here, the tension spring loop 202 is slightly compressed and under tension.

Figure 5:
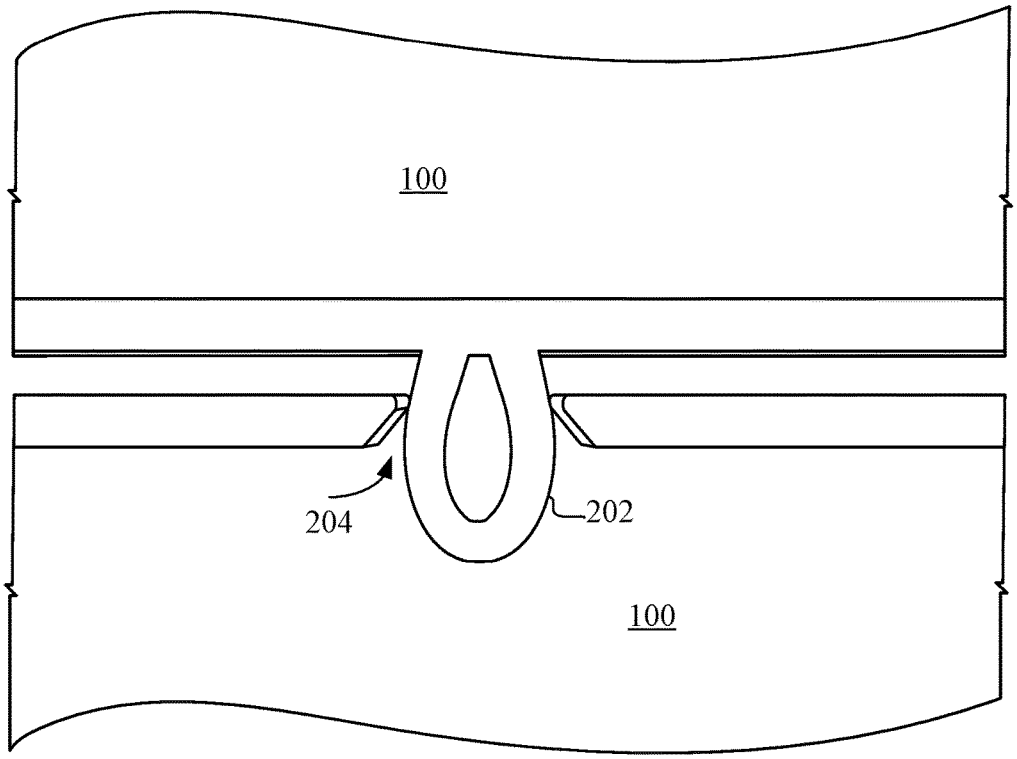
FIG. 5 is another perspective view of a tile showing components of the tension spring system of FIG. 2.

However, it may still be desirable for the tiles 100 to be able to accommodate changes in the environment of the tiles 100 due to expansion and compression. Due to the flexible nature of the material of the tile 100 generally, and the tension spring loop 202, the tile may 100 experience a force (e.g., due to movement of humans or animals across the surface, or a change in the environment such as temperature) sufficient to overcome the tension force between the spring loop 202 and the tapered recess 204 causing the base portion 208 of the spring loop 202 to be partially separated from the tapered recess 204, as shown in FIG. 3. Here, the spring loop 202 may be compressed, which increases interference with the tapered recess 204. A greater inward pressure would therefore be received by each respective tile 100. Lines 220 in FIG. 3 show the movement of the spring loop 202 away from the recess 204. However, due to the flexible nature of the spring loop 202, and the presence of the walls 215 of the recess 204, the spring loop 202 compresses, as shown FIG. 5. This compression increases the tension between the recess 204 and the spring loop 202. When the force is removed, this tension on the spring loop 202 causes the tiles 100 to draw back together.

The force (e.g., tension) created between the tiles 100 can be varied based on the requirements of the various systems. In order to vary the tension, greater or fewer spring loops 202 may be incorporated into respective sides 106 of the tiles 100 (e.g., three spring loops 202 on two adjacent sides 106 of a tile 100). Further, the shape, size, and wall thickness of each the spring loops 101 may be varied to provide greater or lesser tension to the system. For example, a spring loop 202 having a larger wall thickness will require a greater amount of force to overcome the tension in the system in order to separate the tiles 100. Conversely, a spring loop 202 with a smaller wall thickness will require a smaller amount of force to overcome the tension in the system in order to separate the tiles 100. Likewise, increasing and/or decreasing the angles θ, $\theta_2$, and $\theta_3$ may effect the overall tension of the system.

The system may additionally be configured to support one or more components for customizing the synthetic turf system. For example, in one embodiment, the tiles 100 may be configured to receive pipes thereunder. The tiles 100 may be molded such that the pipes fit within predetermined spaces underneath the tiles 100. Alternately, the spaces may be cutout or otherwise formed into the underside of the tiles. For example, the support pegs may be provided in a pattern which may engage with the pipes to hold the pipes in the desired location.

The pipes may be configured to blow forced hot or cold air up through voids in the synthetic turf rug. One end of the pipes may be open for releasing air. Alternately, the pipes may have holes drilled therein to allow air to escape as the air is forced through the pipes.

In an alternative configuration, the pipes may be configured to allow hot or cold liquid to flow through the pipes. In the event that cold liquid flows through the pipes, heat from the synthetic turf may be transferred through the pipe (and subsequently) to the liquid. In the event that hot liquid flows through the pipes, heat from the pipes may radiate outwards to warm the synthetic turf. The liquid may be used for other purposes (e.g., for a sprinkler system for watering grass around the perimeter of the synthetic turf).

The use of hot air and/or hot liquids may be beneficial to, for example, melt snow that accumulates on the synthetic turf surfaces. Additionally, many materials become brittle in cold weather. For example, the material employed for the tiles 100 described above may become brittle in cold temperatures. Therefore, it may be beneficial to incorporate heating capabilities to maintain the flexible nature of the tiles 100.

The use of cold air and/or cold liquids may likewise be beneficial. Because synthetic turf retains heat more than grass, persons on or near the synthetic turf may experience adverse effects of the hot surface. In an extreme situation, contact with the synthetic turf may cause burns to the person or animal coming into contact with the turf. The ability to diffuse some of the heat away from the synthetic turf surface may thus be extremely important.

In another embodiment, the system may additionally or alternately include an attenuation mechanism for varying the hardness of the turf. The mechanism may be configured to be located underneath tiles, or alternately, above the tiles. For example, the mechanism may include one or more airbags (which may also hold other gases) which may be inflated and deflated based on a user's desired hardness. For example, it may be desirable for the airbags to hold more air for football so that the synthetic turf surface is harder, and for the airbags to be somewhat deflated of air when soccer is being played on the surface.

In one embodiment, the air bags may be provided, for example, in a housing. A top of the housing may include a flat surface upon which the synthetic turf (via tiles or otherwise) may be adhered. The top of the housing may be movable with respect to the sides of the housing, and therefore, may be allowed to move up and down as a result of movement on the turf surface or as a result of a change in the vertical space occupied by the airbags. The air may be provided to the airbags using traditional pumps and methods known to those of skill in the art. Similarly, valves, which may be activated remotely, may be activated to release air from the airbags. It shall be recognized that, alternately, the mechanism may be one or more water (or other liquid) bags that may be inflated or deflated based on a user's desired hardness.

In still another alternative, the mechanism may be one or more springs attached to actuators that may increase or decrease the pressure of the springs based on the user's desired hardness. Other mechanisms may additionally, or alternately, be appropriate and are contemplated within the scope of the invention.

In still another embodiment, the system may be equipped with a computer and programming for monitoring one or more activities occurring on the field. A low voltage connection between the tiles, for example, may allow the field to be wired with sensors for tracking players using, for example, radio frequency identification (RFID) technology. Sensors may be located in the tiles and sense signals coming from RFID tags worn by the players. This could be useful for recruiting analysts and TV networks, for example, to easily track the various plays that a particular player has participated in during a predetermined time period (e.g., during the first half, over the course of one game, or a season). Information may be transmitted (e.g., wirelessly over a network, or using any other methods currently known or later developed) to a memory device which may store the information.

The programming may also (or alternatively) be configured to track footsteps in order to determine the most trafficked area of the field for the purpose of setting advertising prices. For example, if it is determined that play on a particular field occurs on the right hash mark of the north side of the field approximately 75% of the time, the owners of the field could charge more for advertising near that hash mark. The footstep tracker may additionally be used by teams to analyze plays and positions of players during the plays.

In another embodiment, the synthetic turf may include fiber optic technology which may be used for advertising purposes. Fiber optic fibers may be tufted into the turf rug in addition to the synthetic turf fibers. Alternately, light diodes may be located on the ends of the synthetic turf. The synthetic turf may include, for example, approximately 25% to 50% fiber optic fibers, or light diodes may be present on approximately 25% to 50% of the synthetic turf fibers. The fiber optic technology may be synced with the footstep tracker, for example, which may allow advertisements to move along the field with the movement of players from one end of the field to another.

The synthetic turf rug may additionally include solar fibers which may be tufted into the rug alongside the synthetic turf fibers. The solar fibers may be connected to an external battery (e.g., a Tesla® battery) for storing solar energy. The battery may then be connected to various applications which require energy, such as the concession stand. It shall be understood by those of skill in the art that the solar fibers may be flexible such that the fibers are virtually indistinguishable from the synthetic turf fibers.

Sensors and programming may also be able to provide real time information on the planarity of the surface of the field. For example, if each tile is connected together in a grid, the system may be configured such that each tile is aware of its surroundings and is able to adjust its height in order to maintain a planar surface and to keep the playing surface as safe as possible.

Still further, the system may be equipped with predictive technology that may increase the cushion before impact. For example, if the field senses (for example, through the foot tracker) two feet in a particular area with rapidly approaching footsteps with a concurrent lack of foot placement on the field, the field may automatically adjust the softness in that area in order to absorb the impact of the person on the field. This may be substantial, as it is believed that nearly 15% of concussions may be due to a player's contact with the field, and not the impact of one player with another.

The synthetic turf system may include one or more of the components described above. For example, the owner of a synthetic turf system may desire a field that incorporates the attenuation features and is able to capture solar energy for power, but does not wish to incorporate fiber optics technology into the field. Or, the owner may desire to take advantage of only the RFID capabilities of the synthetic turf system.

Many different arrangements of the various components depicted, as well as components not shown, are possible without departing from the spirit and scope of the present invention. Embodiments of the present invention have been described with the intent to be illustrative rather than restrictive. Alternative embodiments will become apparent to those skilled in the art that do not depart from its scope. A skilled artisan may develop alternative means of implementing the aforementioned improvements without departing from the scope of the present invention. Further, it will be understood that certain features and subcombinations are of utility and may be employed within the scope of the disclosure, Further, various steps set forth herein may be carried out in orders that differ from those set forth herein without departing from the scope of the present method. This description shall not be restricted to the above embodiments.

The invention claimed is:

1. A spring tension system for a tile, comprising:

a spring loop having a base portion and a hoop portion, the base portion comprising two arms extending outwardly at a first angle from a center-point and joining together to form the hoop portion; wherein the spring loop is formed into a first side of a first tile; and a tapered recess formed into a second side of a second tile, the tapered recess comprising an opening forming two tapered walls extending inwardly toward a center of the second tile at a second angle;

wherein the second angle is smaller than the first angle; and wherein the spring loop formed into the first side of the first tile is received into the tapered recess formed into the second side of the second tile, the spring loop and the tapered recess forming a friction fit.

2. The spring tension system of claim 1, wherein the spring loop is configured from a flexible material.

3. The spring tension system of claim 2, wherein, when the spring loop is inserted into the tapered recess, the spring loop is temporarily deformed from an original shape, the spring loop subsequently returning to the original shape, thereby forming the friction fit.

4. The spring tension system of claim 1, wherein the first angle is between approximately 75 and 85 degrees.

5. The spring tension system of claim 4, wherein the second angle is between 70 and 80 degrees.

6. The spring tension system of claim 1, wherein the friction fit between the spring loop and the tapered recess biases the first side of the first tile and the second side of the second tile into contact.

7. The spring tension system of claim 1, wherein the opening comprises two opposing walls configured at a front angle of between approximately 8 and 12 degrees.

8. The spring tension system of claim 1, wherein the first tile comprises a plurality of spring loops formed into two adjacent sides of the first tile.

9. The spring tension system of claim 8, wherein the second tile comprises a respective plurality of tapered recesses formed into two adjacent sides of the second tile.

10. The spring tension system of claim 8, wherein the first tile comprises four sides, a plurality of spring loops formed into two adjacent sides, and a plurality of tapered recesses formed into the other two adjacent sides.

11. A spring tension system for a tile, comprising:

a spring member formed into a first side of a first tile, the spring member and the tile having a unitary construction; and a recess formed into a second side of a second tile;

wherein the spring member of the first tile is received by the recess in the second tile to form an interference fit, the tension caused by the interference fit causing the first and second tiles to be biased into contact in a normal configuration wherein each of the first and second tiles comprises four sides, a plurality of spring members formed into two adjacent sides, and a plurality of recesses formed into the other two adjacent sides, and wherein the number of recesses on each side corresponds to the number of spring members on each side.

12. The spring tension system of claim 11, wherein, in the normal configuration, the space between the first tile and the second tile is substantially zero.

13. The spring tension system of claim 12, wherein a change in an environment of the first and second tiles causes the tiles to expand, the expansion causing the spring member to temporarily compress and partially exit through the recess from an original position thus creating a space between the first and second tiles, wherein the tension between the spring member and the recess causes the spring member to subsequently return to the spring loop's original position wherein the first and second tiles are biased into contact.

14. The spring tension system of claim 13, wherein the recess comprises two walls forming an opening, wherein the walls are angled away from the opening.

15. A spring tension system for a tile, comprising:

a spring loop having a base portion and a loop portion, the base portion comprising two arms extending outwardly from a first side of a first tile at a first angle, respective ends of the arms joining together to form the loop portion; and a tapered recess formed into a second side of a second wall tile, the tapered recess comprising an opening formed by two walls, each wall having an inner angled edge;

wherein the spring loop formed into the first tile is received into the tapered recess of the second tile to form a friction fit, the friction fit causing the spring loop to bias the respective tiles into contact.

16. The spring tension system of claim 15, wherein when the tiles are biased together, a space between the tiles is substantially zero.

17. The spring tension system of claim 16, wherein a change in an environment of at least one of the first and second tiles causes the spring loop to temporarily compress causing the spring loop to partially exit through the tapered recess from an original position thus creating a space between the first and the second tiles, and wherein the tension between the spring loop and the tapered recess causes the spring loop to subsequently return to the spring loop's original position, thereby biasing the first side of the first tile and the second side of the second tile back into contact; wherein the space between the first and the second tiles is less than 0.1".

* * * * *